United States Patent [19]

Steele

[11] 4,401,854

[45] Aug. 30, 1983

[54] SIMULTANEOUS TRANSMISSION OF AN ANALOG MESSAGE SIGNAL AND A DIGITAL DATA SIGNAL

[75] Inventor: Raymond Steele, Hazlet, N.J.

[73] Assignee: Bell Telephone Laboratories, Incorporated, Murray Hill, N.J.

[21] Appl. No.: 289,835

[22] Filed: Aug. 3, 1981

[51] Int. Cl.[3] ..... H04K 1/02

[52] U.S. Cl. ..... 179/1.5 R; 178/22.15

[58] Field of Search ..... 179/1.5 R, 2; 455/26, 455/27; 375/2.1, 2.2; 358/142; 325/20; 178/22.15

[56] References Cited

U.S. PATENT DOCUMENTS

| | | | |
|---|---|---|---|
| 3,304,372 | 2/1967 | Filipowsky | 179/2 |
| 3,406,344 | 10/1968 | Hopper | 325/50 |
| 3,700,793 | 10/1972 | Borsuk et al. | 358/142 |
| 3,723,878 | 5/1973 | Miller | 179/1.5 R |
| 3,723,956 | 3/1973 | Carman | 455/26 |
| 4,034,404 | 7/1977 | Nakagome et al. | 358/142 |
| 4,100,374 | 7/1978 | Jayant et al. | 179/1.5 R |
| 4,237,484 | 12/1980 | Brown et al. | 358/142 |
| 4,361,729 | 11/1982 | Barnes et al. | 375/2.1 |

OTHER PUBLICATIONS

IEEE Trans. on Comm. Tech (8/71) Sherman, pp. 551-555, "Storage and Delay Estimates for Multiplex of Data in Speech".

IEEE Trans. on Comm. (11/75) Feher et al., pp. 1321-1327.

IEEE Trans. on Comm. (12/75) Feher et al., (II) pp. 1509-1514.

Bell System Tech. Journal, vol. 56, No. 5 (6/77) Kak et al., pp. 781-808 "On Speech Encryption Using Wave Form Scrambling".

IEEE Trans. on Info. Theory, vol. IT-25, No. 3, (5/79), Hinich, pp. 354-356, "Quadratic Multiplexing . . . ".

*Primary Examiner*—Salvatore Cangialosi

*Attorney, Agent, or Firm*—Erwin W. Pfeifle

[57] ABSTRACT

In its most general form, the present invention may be employed to simultaneously transmit information, either digital or analog, from two separate and distinct sources, denoted A and B, where the information from at least one of the sources, for example, A, possesses some known statistical properties of coherence. The less coherent information from, for example, source B, is used to generate a set of scrambling key sequences, where each separate scrambling key sequence is associated with a unique segment of information from source B. The key sequences are used to scramble the information from source A, and the scrambled information is produced as the output of the transmitter. In one form, the information from source A could be an analog signal (x(t)) and the information from source B could be a digital data sequence ($\{d_k\}$) which is capable of transmitting n data bits per every N samples of the analog signal from source A. In particular, each sequential block of N samples of the analog signal is scrambled in M unique ways ($S_1-S_M$), where $M=2^n$, and the M scrambled sequences are associated in a one-to-one relationship with the M possible combinations of data elements ($d_1-d_M$) that could possibly be transmitted. The particular scrambled sequence ($S_i$) associated with the data element desired to be transmitted ($d_i$) is thus dispatched as the output signal ($S_T$) of the transmitter. At the receiving end, the reverse processes take place, allowing the listener to recover information from both sources A and B.

19 Claims, 8 Drawing Figures

SIMULTANEOUS TRANSMISSION OF AN ANALOG MESSAGE SIGNAL AND A DIGITAL DATA SIGNAL

BACKGROUND OF THE INVENTION

1. Field of the Invention

The present invention relates to method and apparatus for the simultaneous transmission of two or more signals, for example, an analog message signal and a digital data signal, and more particularly, to method and apparatus wherein one signal is scrambled using another signal as the scrambling key. The receiver, by adopting the role of code-breaker, will be capable of recovering the separate signals from the transmitted signal.

2. Description of the Prior Art

There exist numerous systems which attempt to multiplex digital data with an analog signal, where the analog signal is usually limited to either speech or video. One early technique for voice-data multiplexing, disclosed in U.S. Pat. No. 3,304,372 issued to R. F. J. Filipowsky et al on Feb. 14, 1967, relates to a voice-data multiplexing system for transmitting data during pauses in the voice signal. As taught in Filipowsky et al, voice signals are normally gated onto a transmission channel at the transmitter, but whenever gaps exceeding a minimum interval are sensed in the voice signals, a data source is activated and data transmission begins with the dispatch of a keying signal over the transmission channel. The keying signal is followed by the appearance of data signals. At the receiver, reception of the keying signal alerts the receiver and causes the subsequently received data signals to be read into a data store. The above-described system, however, is necessarily limited to multiplexing data with only speech signals, which are known to have extended periods of silence, as shown by studies which indicate that in a full duplex voice communication, each of the two channels remains idle, on the average, sixty-seven percent of the time.

There also exist methods of incorporating digital data with microwave analog signals, variously termed data-above-voice (DAV), data-under-voice (DUV), and data-above-video (DAVID). The former two systems are described in the article "1.544 Mbit/s Data Above FDM Voice and Data Under FDM Voice Microwave Transmission" by K. Feher et al in *IEEE Transactions on Communication,* November 1975, at pp. 1321–1327, while the latter method is described in the article "Simultaneous Transmission of Digital Phase-Shift Keying and of Analog Television Signals" by K. Feher et al in *IEEE Transactions on Communication,* December 1975, at pp. 1509–1514. As described in both articles, the data is transmitted in the unused portion of the spectrum, either below or above that portion dedicated to the microwave voice or video signal. Therefore, in order to apply any of the DAV, DUV, or DAVID techniques, the system must have wideband capability with only narrowband (voice, video) information to transmit.

There does exist an alternative to the above-described DAVID technique, which is not dependent on the bandwidth of the system. U.S. Pat. No. 4,237,484 issued to E. F. Brown et al on Dec. 2, 1980 discloses a technique for transmitting digital data together with a video signal. The video signal is applied to a predictive encoder which predicts the value of each of a first set of samples thereof, based upon the value of other ones of the samples. The predicted and true values of the samples in the first set are compared, and the resulting error values are compressed to a narrower range. A value indicative of the supplementary data is then superimposed upon the compressed values, and the composite value is time multiplexed with the remaining samples of the input video signal.

There exists a limitation in all of the above-described prior art systems, however, in that the digital data desired to be transmitted may be multiplexed with only voice or video signals. No other analog signal is employed in any of the above-described arrangements since each prior art technique exploits a particular property of either voice (prolonged periods of silence, narrow bandwidth) or vide (predictability).

SUMMARY OF THE INVENTION

The limitation associated with the prior art has been overcome by the present invention which relates to method and apparatus for the simultaneous transmission of two or more signals, for example, an analog message signal and a digital data signal, and more particularly, to method and apparatus wherein one signal is scrambled using another signal as the scrambling key. The receiver, by adapting the role of code-breaker, will be capable of recovering the separate signals from the transmitted signal.

It is an aspect of the present invention to employ a scrambling key that is easy to break, for example, frequency inversion, since the object of the invention is to allow the receiver to break the code at nearly every attempt, and thereby recover both the correlative analog signal and the data.

It is another aspect of the present invention to achieve transmission of a data stream with any type of analog signal possessing minimal correlative qualities, as for example, speech, television, facsimile, analog-plant control signals, etc.

Other and further aspects of the present invention will become apparent during the course of the following description and by reference to the accompanying drawings.

BRIEF DESCRIPTION OF THE DRAWING

Referring now to the drawings, where like numerals represent like parts in several views.

DETAILED DESCRIPTION

In its most general form, the present invention may be employed to simultaneously transmit information, either digital or analog, from two separate and distinct sources, denoted A and B, where the information from at least one of the sources, for example, A, possesses some known statistical properties of coherence. The less coherent information from, for example, source B, is used to generate a set of scrambling key sequences, where each separate scrambling key sequence is associated with a unique segment of information from source B. The key sequences are used to scramble the information from source A, and the scrambled information is produced as the output of the transmitter. At the receiving end, each scrambling key sequence employed by the transmitter is applied in reverse to the received scrambled sequence. By determining which specific key sequence results in recovering the original information (either digital or analog) from source A, the receiver also recovers the information (also either digital or analog) from source B associated with the successful scrambling sequence.

Figure 1:
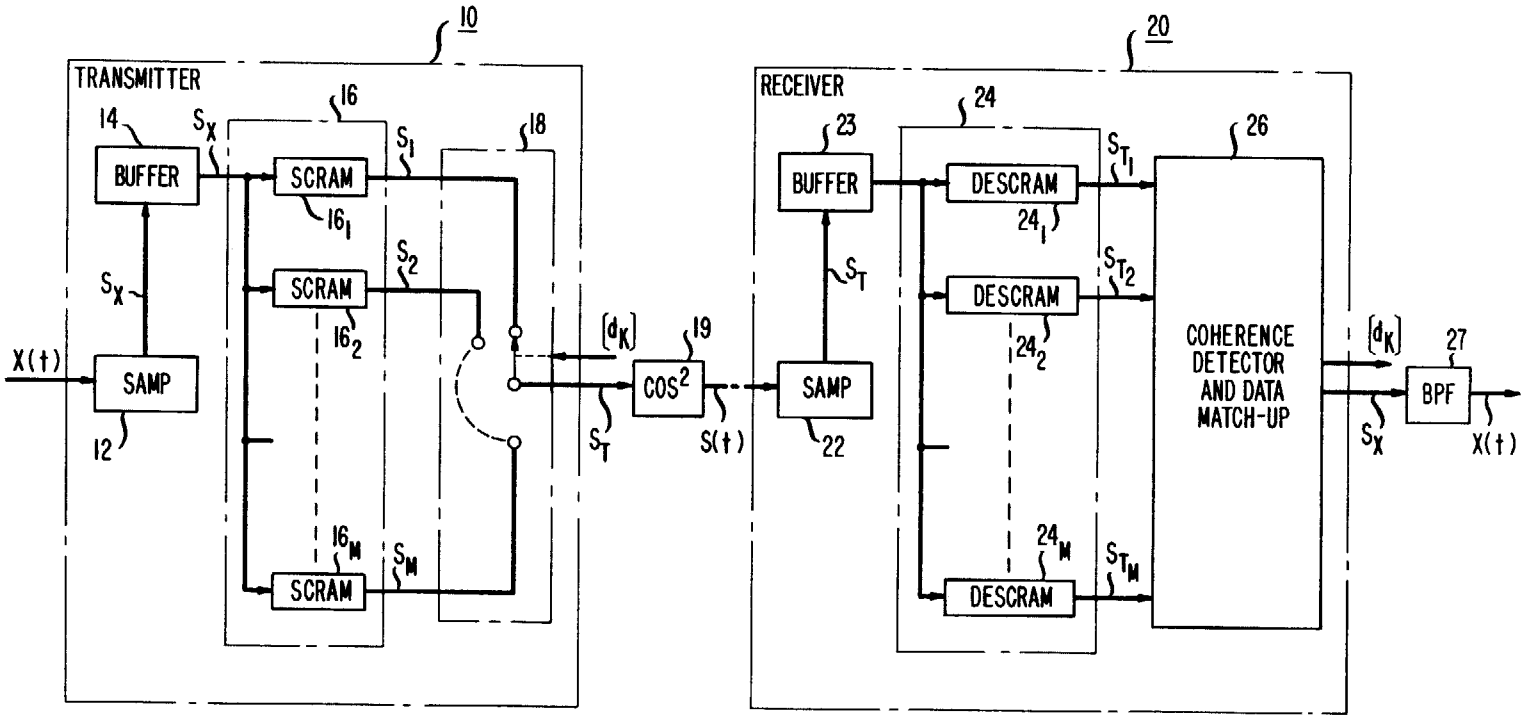
FIG. 1 illustrates a communication system for simultaneously transmitting digital data and a correlative analog signal in accordance with the present invention.

A block diagram of a transmission system capable of simultaneously transmitting an analog signal and a digital data stream formed in accordance with the present invention is illustrated in FIG. 1, where the individual system components are described in greater detail hereinafter in the discussion associated with FIGS. 2–7. In general, a correlative analog signal x(t) and a digital data stream $\{d_k\}$ enter a transmitter 10, as illustrated in FIG. 1 and further detailed in FIG. 2, and are therein transformed into a multiplexed sequence $S_T$ produced as an output of transmitter 10. Transmitter 10 comprises, as shown in FIG. 1, a sampler 12 which samples the analog input signal at a predetermined rate to produce a sequence $S_x$ related thereto. The sequence $S_x$ is subsequently applied as an input to a buffer 14, which on the receipt of N samples, dispatches them to a scrambler 16. Scrambler 16, as shown in FIG. 1, includes a bank of individual scramblers labeled $\mathbf{16}_1$–$\mathbf{16}_M$, where each scrambler forms a unique sequence related to the input sequence $S_x$. The number of scramblers, M, employed in the present invention is related to the number of data bits, n, transmitted per every set of N analog signal samples by the relation $2^n = M$. Thus, if two data bits are to be transmitted, the sequence of four possible elements $d_i$ forming $\{d_k\}$ are (00, 01, 10, 11), and, therefore, $2^2$, or four scramblers are included in scrambler 16. Alternatively, if sets of three data bits are to be transmitted, scrambler 16 would include $2^3$, or eight separate scramblers, or, if only one data bit is to be transmitted per every set of N analog signal samples, at most two scramblers would be included in scrambler 16. As will be discussed hereinafter in association with FIGS. 4–8, if only one data bit is to be transmitted, a single scrambler may be employed to perform in accordance with the present invention.

As shown in FIG. 1, scrambler 16 produces M unique N-length sequences denoted $S_1, S_2, \ldots, S_M$, where $S_1$ is the output sequence produced by scrambler $\mathbf{16}_1$, $S_2$ is produced by scrambler $\mathbf{16}_2$, and so on, where $S_M$ is the output sequence produced by scrambler $\mathbf{16}_M$. The M N-length sequences $S_1$–$S_M$ are subsequently applied as separate inputs to a switch 18 which is also responsive to data stream $\{d_k\}$. The output of switch 18 is one of the M input sequences and is determined by the value of the current element $d_i$ of the data stream $\{d_k\}$ to be transmitted, since each unique N-length data element is associated in a one-to-one relationship with the M sequences $S_1$–$S_M$. For example, if $n=2$, there exists $2^n$, or four, unique data elements $d_i$: $d_1=00$, $d_2=01$, $d_3=10$, and $d_4=11$, where $d_1$ may be associated with scrambled sequence $S_1$, $d_2$ with $S_2$, $d_3$ with $S_3$, and $d_4$ with scrambled sequence $S_4$. Therefore, for this example, if the data stream $\{d_k\}$ was equal to an exemplary stream {(01), (11), (10), (00), (01), (00)}, or {d2, d4, d3, d1, d2, d1}, the transmitted sequence $S_T$ would consist of the set of scrambled sequences $\{S_2, S_4, S_3, S_1, S_2, S_1\}$.

In order to be transmitted as an analog signal, the set of sequences forming $S_T$ must be passed through a filtering means 19, which functions to form a continuous signal denoted s(t). A raised cosine function, for example, is capable of spreading the time duration of the bits forming $S_T$ to form the continuous signal s(t).

As shown in FIG. 1, the signal s(t) produced by filtering means 19 travels through the communication medium and is subsequently processed by receiver 20 to be reconverted into the original analog signal x(t) and the data stream $\{d_k\}$. As shown in FIG. 1, the signal s(t) is first applied as an input to a sampler 22 which operates at the same sampling rate as sampler 12 of transmitter 10. The output of sampler 22, therefore, will be the transmitted sequence $S_T$ produced by switch 18 of transmitter 10. It is to be noted that the output of sampler 22 will equal the transmitted sequence $S_T$ only under ideal conditions and, in general, signal degradation will occur to signal s(t) as it travels through the communication medium. However, any of the well-known channel equalization techniques may be employed to limit the amount of signal degradation. For the remainder of the present discussion, therefore, it will be assumed that the system employed comprises ideal channels to avoid confusion in presenting the concepts involved in the present invention.

Returning to FIG. 1, the sampled sequence $S_T$ produced by sampler 22 is subsequently applied as an input to a buffer 23 which stores the samples and dispatches each group of N samples associated with a particular data sequence to the remainder of receiver 20 and continues to do so for subsequent groups of N samples. Although it is not shown in the figures, it will be understood that synchronization between buffers 14 and 23 of transmitter 10 and receiver 20, respectively, is necessary in order to ensure that the correct set of N samples is dispatched by buffer 23. For example, synchronization may be achieved by transmitting at regular intervals a control message to receiver 20, where receiver 20 is knowledgable of the contents of the control message. Alternatively, a clocking signal may be transmitted over a separate channel (not shown) between transmitter 10 and receiver 20. Each N-length group of samples dispatched by buffer 23 is subsequently applied as M separate inputs to a descrambler 24, where descrambler 24 includes a bank of M descramblers denoted $\mathbf{24}_1$–$\mathbf{24}_M$, where the number of descramblers employed is equal to the number of scramblers employed by transmitter 10. In operation, each descrambler performs the reverse process of its associated scrambler $\mathbf{16}_1$–$\mathbf{16}_M$ of transmitter 10, that is, descrambler $\mathbf{24}_1$ performs the inverse operation of scrambler $\mathbf{16}_1$ to produce an output sequence $S_{T1}$, descrambler $\mathbf{24}_2$ the inverse of scrambler $\mathbf{16}_2$ to produce a sequence $S_{T2}$, and so on, where descrambler $24_M$ performs the inverse operation of scrambler $16_M$ to produce an output sequence $S_{TM}$.

In accordance with the present invention, only one of the sequences $S_{T1}$–$S_{TM}$ will coincide with the original N-length sequence $S_X$. Therefore, to determine at a particular period of time which of the M sequences $S_{T1}$–$S_{TM}$ produced by descrambler 24 is the sequence $S_X$, sequences $S_{T1}$–$S_{TM}$ are applied as separate inputs to a coherence detector 26. The function of coherence detector 26 is to identify the sequence $S_X$ and in doing so, identify the data stream $\{d_k\}$.

As stated hereinabove, as only one of the M sequences $S_{T1}$–$S_{TM}$ produced by descrambler 26 will corresponds to $S_X$ (or an approximation thereof due to channel impairments), the remaining M-1 sequences will be relatively incoherent. Therefore, by simultaneously analyzing predetermined statistical properties of the M sequences $S_{T1}$–$S_{TM}$, coherence detector 26 will be able to ascertain which sequence of $S_{T1}$–$S_{TM}$ coincides with the original sequence $S_x$. Also, since each sequence $S_{T1}$–$S_{TM}$ is also associated with a separate one of M unique sets of N-length data elements $d_1$–$d_M$, the associated data is also recovered. Using the example from above, if M=4, and it is desired by the transmitter to dispatch the data element $d_2$(0, 1), the related transmitted portion of $S_T$ will be equal to $S_2$. Therefore, in accordance with the present invention, the output sequence $S_{T2}$ of descrambler 24 will be coherent and the remaining output sequences $S_{T1}$, $S_{T3}$, and $S_{T4}$ will remain incoherent scrambled sequences. Thus, coherence detector 26, by analyzing the sequences $S_{T1}$–$S_{T4}$ will determine that since sequence $S_{T2}$ is the most coherent of the sequences $S_{T1}$–$S_{T4}$, the sequence $S_2$ must have been transmitted as $S_T$ and, therefore, the associated data of $S_2$, $d_2$ (01), was also transmitted. Consequently, receiver 20 outputs the sequence $S_{T2}$, ideally a replica of $S_X$, and the data sequence $d_2$.

One statistical property that coherent detector 26 may analyze to ascertain which sequence of the M possible N-length sequences $S_{T1}$–$S_{TM}$ is the coherent analog sequence $S_X$, is the correlation coefficient of the N elements comprising the specific sequence, which may be defined as $$\rho = \frac{\sum_{i=0}^{N-2} x_i x_{i+1}}{\sum_{i=0}^{N-1} x_i^2}. \quad (1)$$

Figure 2:
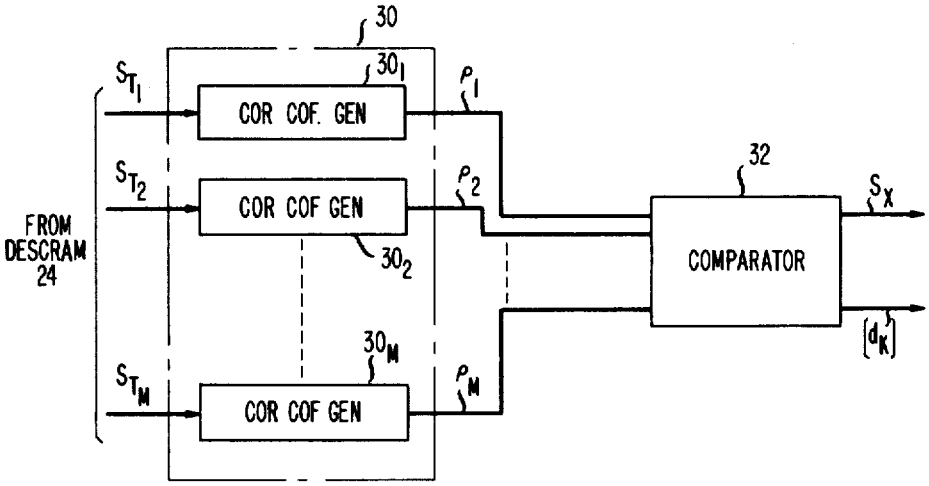
FIG. 2 contains a preferred embodiment of an exemplary receiver formed in accordance with the present invention.

As is well-known, the higher the value of the correlation coefficient of a particular set of samples, the more likely the sequence is a coherent sequence and not merely a scrambled incoherent set of samples. Thus, an exemplary coherence detector 26 as illustrated in FIG. 2 will be capable of ascertaining which scrambled sequence ($S_1$–$S_M$) and associated data element ($d_1$–$d_M$) was transmitted. As shown in FIG. 2, each sequence $S_{T1}$–$S_{TM}$ produced by descrambler 24 is applied as a separate input to one of a set of M correlation coefficient generators $30_1$–$30_M$. An exemplary correlation coefficient generator may be a part of a microprocessor or minicomputer capable of solving above-defined equation (1). Subsequently, the M correlation coefficients $\rho_1\rho_M$ produced by the M correlation coefficient generators $30_1$–$30_M$, respectively, are applied as separate inputs to an M-input comparator 32.

Comparator 32 functions to compare progressive pairs of correlation coefficients, retaining the larger of the pair, $\rho_i$, and the identity of the channel, i, related to that particular correlation coefficient. For example, if there exist four correlation coefficients $\rho_1$, $\rho_2$, $\rho_3$, $\rho_4$ comprising the exemplary values 0.01, 0.30, 0.85, and 0.06, respectively, comparator 32 would first compare $\rho_1$ and $\rho_2$ and retain both the actual value of $\rho_2$, 0.30, and its associated channel designation, 2. Next, comparator 32 would compare $\rho_2$ and $\rho_3$, discard the value of $\rho_2$ and its related channel designation, and retain the actual value of $\rho_3$, 0.85, and its associated channel designation, 3. Finally, comparator 32 would compare $\rho_3$ to $\rho_4$, and since $\rho_3$ is greater than $\rho_4$, comparator 32 would retain both the actual value of $\rho_3$, 0.85, and its associated channel designation, 3. Subsequently, comparator 32 pairs the remaining channel designation, in this case 3, with its associated descrambled sequence $S_{T3}$, where the output of comparator 32 will be, therefore, both descrambled sequence $S_{T3}$ and data element $d_3$. Generally, therefore, in accordance with the present invention, comparator 32 will produce as separate outputs descrambled sequence $S_{Ti}$ and its associated data element $d_i$ related to the channel i which produced the largest correlation coefficient $\rho_i$. Therefore, the separate outputs of comparator 32 will be the data element $d_i$ and sequence $S_x$ desired to be transmitted by transmitter 10.

Alternatively, coherent detector 26 of FIG. 1 may determine which sequence $S_{T1}$–$S_{TM}$ is associated with the original sequence $S_x$ by counting the number of zero-crossings and determining the means square value of each sequence $S_{T1}$–$S_{TM}$, and, if statistical knowledge between the number of zero-crossings and mean square value of the original analog signal x(t) is known to the receiver, identification of the correct $S_{T1}$–$S_{TM}$ sequences may be performed. Other forms of coherence detection may be used, the essential prerequisite for their successful operation is a knowledge of the statistical properties that render one sequence in $S_{T1}$–$S_{TM}$ statistically significantly different from the others, and similar to $S_X$.

As shown in FIG. 1, the original signal x(t) related to the N-length sequences $S_x$ recovered by coherent detector 26 may be obtained by filtering the sequence $S_x$ through a bandpass filter 27. Therefore, receiver 20 is capable of recovering both the analog signal x(t) and associated data element $d_i$ desired to be transmitted by transmitter 10.

Figure 3:
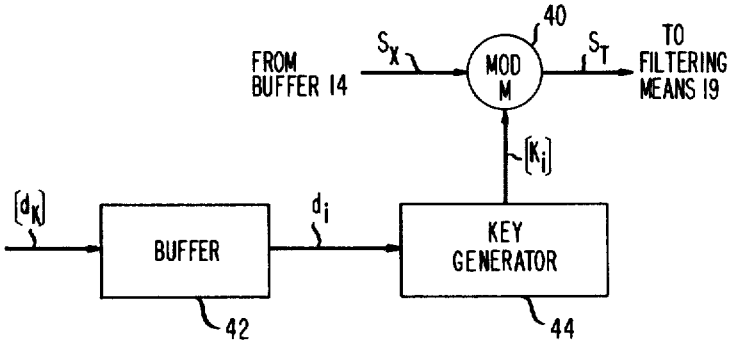
FIG. 3 contains a preferred embodiment of an exemplary scrambling arrangement formed in accordance with the present invention.

An alternative arrangement of scrambler 16 and switch 18 is illustrated in FIG. 3. As shown, each N-length sequence $S_x$ subsequently produced by buffer 14 is applied as a first input to a modulo-M adder 40. Data sequence $\{d_k\}$ is applied as an input to a buffer 42 which, on the receipt of n-samples, dispatches them as a data element $d_i$ to be applied as an input to a key generator 44. Key generator 44, which may be included in a read-only memory (ROM), comprises a table containing a plurality of M N-length unique key sequences $\{K_1\}$, $\{K_2\}$, . . ., $\{K_m\}$, where the sequences are associated in a one-to-one relationship with the M possible data elements $d_1$–$d_M$ which may be applied as an input thereto. The N-length key sequence $\{K_i\}$ associated with the current data element $d_i$ becomes the output of key generator 44 and is subsequently applied as a second input to modulo-M adder 40. The output of modulo-M adder 40, therefore, will be the modulo-M sum of the input sequence $S_x$ and a particular one of the M key sequences $\{K_1\}$–$\{K_M\}$ to form the sequence $S_T$ which is dispatched by transmitter 10. Since there exist M unique key sequences associated in a one-to-one relationship with the M possible data sequences that could be transmitted, modulo-M adder 40 is capable of producing, at any one time, one of a set of M unique sequences $S_1$-$S_M$ as the transmitted sequence $S_T$.

Figure 4:
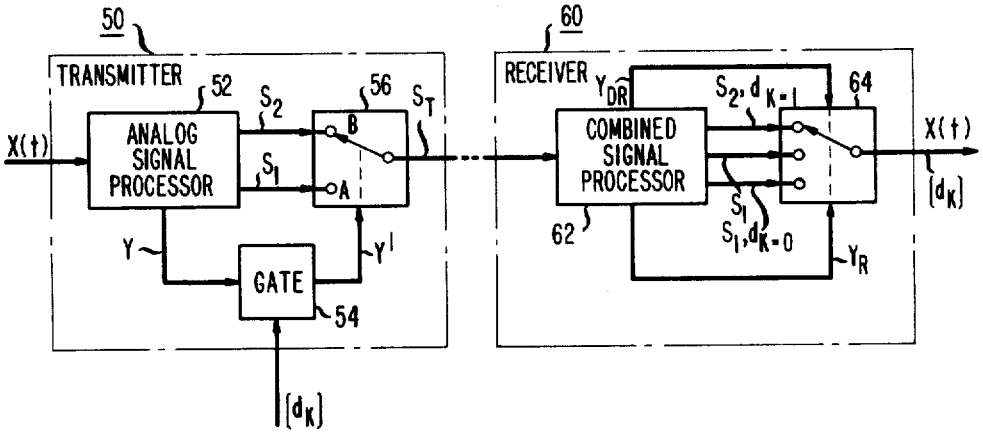
FIG. 4 illustrates an alternative embodiment of a communication system for simultaneously transmitting digital data and a correlative analog signal in accordance with the present invention.

As mentioned hereinbefore, if only a single data bit is to be transmitted for every N samples of the analog signal, a single scrambler is capable of obtaining the object of the invention. A system illustrating this particular embodiment of the proposed invention is shown in FIG. 4. Transmitter 50, as shown in FIG. 4, includes an analog signal processor 52, a gate 54, and a switch 56, where analog signal processor 52 receives the analog signal x(t) and processes the signal in a manner to be described in greater detail hereinafter to produce simultaneously a first output sequence $S_1$, a second output sequence $S_2$, and a control signal y, where the second sequence $S_2$ is a scrambled version of the first sequence $S_1$. The first and second output sequences $S_1$ and $S_2$, are subsequently applied as separate inputs to switch 56, and control signal y is applied as a first input to gate 54. The second input to gate 54 is the data sequence $\{d_k\}$, as shown in FIG. 4. Gate 54, as described in greater detail hereinafter, responds to both control signal y and data sequence $\{d_k\}$ to produce a switch control signal y', which is applied to switch 56 to control the operation of switch 56. Switch control signal y', therefore, will determine, by a method to be described hereinafter, which sequence, $S_1$ or its scrambled version $S_2$, is to be transmitted as the output sequence $S_T$.

After travelling through the communication medium, the original analog signal x(t) and the digital data sequence $\{d_k\}$ are recovered from the transmitted sequence $S_T$ through a receiver 60 as illustrated in FIG. 4. It will be assumed for the purposes of the present discussion that all signal paths are ideal channels, thereby allowing receiver 60 to recover both analog signal x(t) and data sequence $\{d_k\}$. It is to be understood, however, that in implementation of the present invention in association with non-ideal channels, signal distortion may occur where such distortion may be appreciably reduced by employing any of the well-known channel equalization techniques as for example, the method discussed in *Principles of Communications*, R. F. Ziemer et al, Haughton Miflin Co., Boston, 1976, at pp. 353–356, thereby allowing receiver 60 to recover very good approximations of both correlative analog signal x(t) and data sequence $\{d_k\}$.

As illustrated in FIG. 4, receiver 60 includes a combined signal processor 62 and a switch 64. Basically, combined signal processor 62, which is described in greater detail hereinbelow, processes the received sequence $S_T$ and produces simultaneously three distinct output sequences, $S_2$, $d_k=1$, $S_1$, $d_k=0$, $S_1$, and a pair of control signals $y_R$ and $y_{DR}$. The sequences $S_2$, $d_k=1$, $S_1$, $d_k=0$ and $S_1$ are subsequently applied as separate inputs to switch 64, where the positioning of switch 64 is controlled by control signals $y_R$ and $y_{DR}$.

In operation, if control signals $y_R$ and $y_{DR}$ allow switch 64 to connect, for example, the sequence $S_2$, $d_k=1$ to the output signal path, this positioning of switch 64 is interpreted as indicating that the scrambled sequence $S_2$ produced by analog processor 52 and a data bit equal to a logical "1" were transmitted. Instead, if control signals $y_R$ and $y_{DR}$ allow switch 64 to connect the sequence $S_1$, $d_k=0$ to the output signal path, this positioning is interpreted as indicating that the non-scrambled sequence $S_1$ produced by analog processor 52 and a data bit equal to a logical "0" were transmitted. Lastly, if switch 64 is connected to the remaining input, $S_1$, this is interpreted as meaning the above-described sequence $S_1$ was transmitted without any data bit related thereto. The exact nature of these sequences, and the detailed operation of combined signal processor 62, are contained in the following description associated with FIGS. 5–7.

Figure 5:
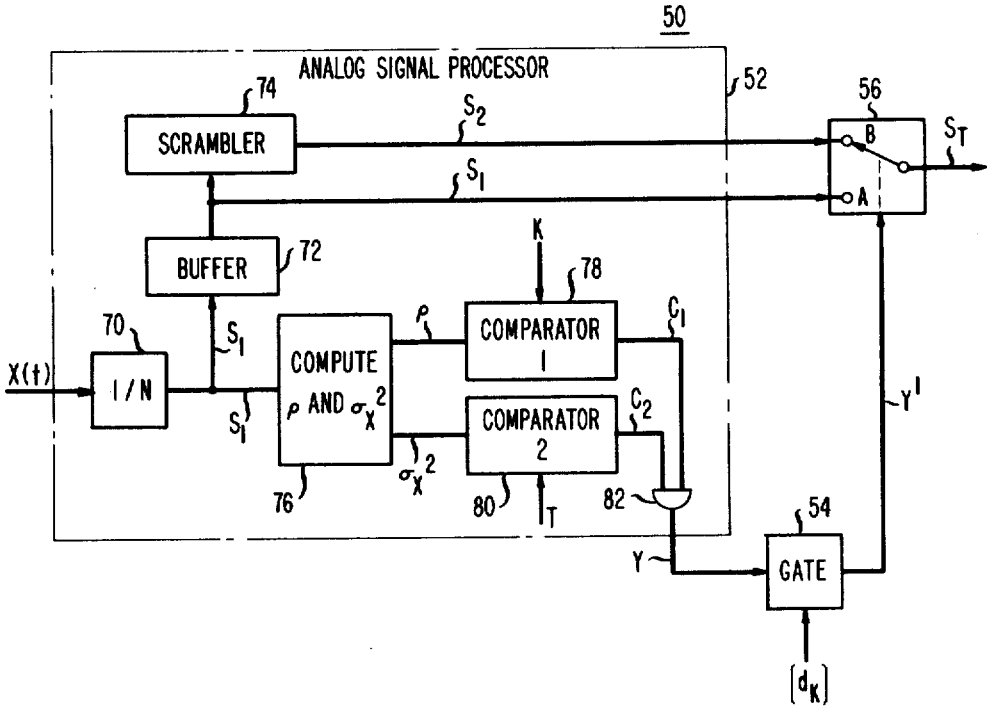
FIG. 5 contains a preferred embodiment of an exemplary transmitter which may be employed in the system of FIG. 4 in accordance with the present invention.

An exemplary transmitter 50 formed in accordance with the present invention is illustrated in detail in FIG. 5. In this exemplary arrangement, correlative analog signal x(t) is first applied to a sampler 70 which, by sampling x(t) at the Nyquist rate, produces N samples of x(t) every t seconds. These samples are applied as an input to a buffer 72, which on receipt of N samples dispatches them to scrambler 34 and computation means 36. One exemplary N-length sequence $S_1$ as produced by sampler 70 may be defined by $$S_1 = x_0, x_1, \ldots, x_{N-1}. \tag{2}$$

Buffer 72 works on the principle of "first in, first out." Thus, after samples $x_0, x_1, \ldots, x_{N-1}$ have been conveyed to scrambler 74 and computation means 76, and while they are being processed, buffer 72 is acquiring from scrambler 70 the next sequence $x_n, x_{N+1}, \ldots, x_{2N-1}$, where buffer 72 will continue to operate in a like manner for the duration of the transmission. The remainder of the discussion of the present invention will focus on the transmission and reception of a single block of N samples, forming an exemplary sequence $S_1$, where it is to be understood that as practiced, the present technique is an on-going process, with blocks of N samples continuously being generated and processed by analog processor 52.

As shown in FIG. 5, the sequence $S_1$ is applied both as an output of analog signal processor 52 and as an input to a scrambler 74, where in this exemplary arrangement scrambler 74 is a frequency inversion scrambler. Frequency inversion, a very basic scrambling method, is employed since the object of the invention is to allow receiver 60 to "break" the code and recover both the signal x(t) and the data $\{d_k\}$. In particular, scrambler 74 merely alters the polarity of every other sample of $S_1$ to produce, as the second output sequence $S_2$ of analog processor 52, the sequence $$S_2 = x_0, -x_1, \ldots, -x_{N-1}. \tag{3}$$

The frequency inversion process of scrambler 74 is capable of being performed by any type of microprocessor which is capable of negating the value of alternate input samples applied thereto. The nonscrambled sequence $S_1$, and its associated scrambled sequence $S_2$, are subsequently applied as separate inputs at terminals A and B, respectively, of switch 56, as described hereinabove in association with FIG. 4.

The determination of which sequence, $S_1$ or $S_2$, is to be connected to the output of switch 56 is governed by control signal y, the third output of analog processor 52 which is formed by the following process. First, the sequence $S_1$ produced by buffer 72 is applied as an input to a computation means 76 which calculates both a parameter $\rho$ and a power value $\sigma_x^2$ related to the N-length sequence $S_1$. Specifically, the parameter $\rho$, defined here as a correlation coefficient is determined by equation (1), and is repeated here for the sake of convenience $$\rho = \frac{\sum_{i=0}^{N-2} x_i x_{i+1}}{\sum_{i=0}^{N-1} x_i^2}, \quad (4)$$

where the values of $x_i$ are the elements of the sequence $S_1$, as defined by equation (2). The power value $\sigma_x^2$ related to these same $x_i$ values is determined by the equation $$\sigma_x^2 = \frac{1}{N} \sum_{i=0}^{N-1} x_i^2. \quad (5)$$

Correlation coefficient $\rho$ and power value $\sigma_x^2$ produced by computation means 76 are subsequently applied as separate inputs to a first comparator 78 and a second comparator 80, correlation coefficient $\rho$ being applied to first comparator 78 and power value $\sigma_x^2$ being applied to second comparator 80. In operation, first comparator 78 compares correlation coefficient $\rho$ to a predetermined constant K, where $p > K$ generally implies that the block of N samples forming $S_1$ are strongly correlated. Comparator 78 subsequently produces as an output a control signal $C_1$ where $$C_1 = \begin{cases} \text{logical 1; if } \rho \geqq K \\ \text{logical 0; if } \rho < K \end{cases}. \quad (6)$$

In a similar manner, second comparator 80 compares power value $\sigma_x^2$ to a predetermined constant T where $\sigma_x^2 > T$ generally implies that the block of N samples forming $S_1$ comprise a power level well above that of any background noise. Comparator 80 subsequently produces as an output a control signal $C_2$ where $$C_2 = \begin{cases} \text{logical 1; if } \sigma_x^2 \geqq T \\ \text{logical 0; if } \sigma_x^2 < T \end{cases}. \quad (7)$$

Control signals $C_1$ and $C_2$ are subsequently applied as separate inputs to and AND gate 82, where the output of AND gate 82 is the control signal y produced by analog processor 52 and is represented by the logical equation $$y = C_1 C_2. \quad (8)$$

Therefore, control signal y will equal a logical 1 and activate gate 54 if and only if the sequence $S_1$ has a correlation coefficient above the system threshold ($C_1 = 1$) and comprises a power value above the system threshold ($C_2 = 1$).

The control signal y' produced by gate 54 which activates switch 56 is thus responsive to both control signal y and data sequence $\{d_k\}$, where data sequence $\{d_k\}$ selects which sequence, $S_1$ (position A of switch 56) or $S_2$ (position B of switch 56), will be the output of transmitter 50, as long as equation (8) is satisfied. That is, if control signal y is equal to a logical 1, switch 56 is set in position A if the associated data bit of the data sequence $\{d_k\}$ is a logical 0, or set in position B if the data bit is a logical 1. Thus, the transmitted sequence $S_T$ is generated according to $$S_T = \begin{cases} S_1; \text{ if data bit = logical 0 and } y = 1 \\ S_2; \text{ if data bit = logical 1 and } y = 1 \end{cases}. \quad (9)$$

Whenever control signal $y = 0$ (i.e., the input signal has either a low power value or a low correlation coefficient), the data bit present at gate 54 is ignored and the output sequence $S_T$ is the nonscrambled sequence $S_1$. An included Table A illustrates all the possible combinations of control signal y, data sequence $\{d_k\}$, and the output sequence $S_T$ associated with each situation.

TABLE A

| $y_R$ or $y = C_1C_2$ | data | $S_T$ |
|---|---|---|
| 0 | 1 or 0 | $S_1$, no data |
| 1 | 1 | $S_2$, data = 1; $S_2$, $d_k = 1$ |
| 1 | 0 | $S_1$, data = 0; $S_1$, $d_k = 0$ |

Therefore, in accordance with the present invention, if both the correlation coefficient $\rho$ and the power value $\sigma_x^2$ of the sequence $S_1$ exceed system thresholds, data is alowed to be transmitted. If the data bit is a logical 0, the sequence $S_1$ is sent without modification, but if the data bit is a logical 1, frequency inversion scrambling of the sequence $S_1$ occurs and the scrambled sequence $S_2$ is transmitted. It is to be understood that the components forming transmitter 50 illustrated in FIG. 5 are readily available, where specifically sampler 70, scrambler 74, computational means 76, may be implemented by, for example, a microprocessor arrangement.

Figure 6:
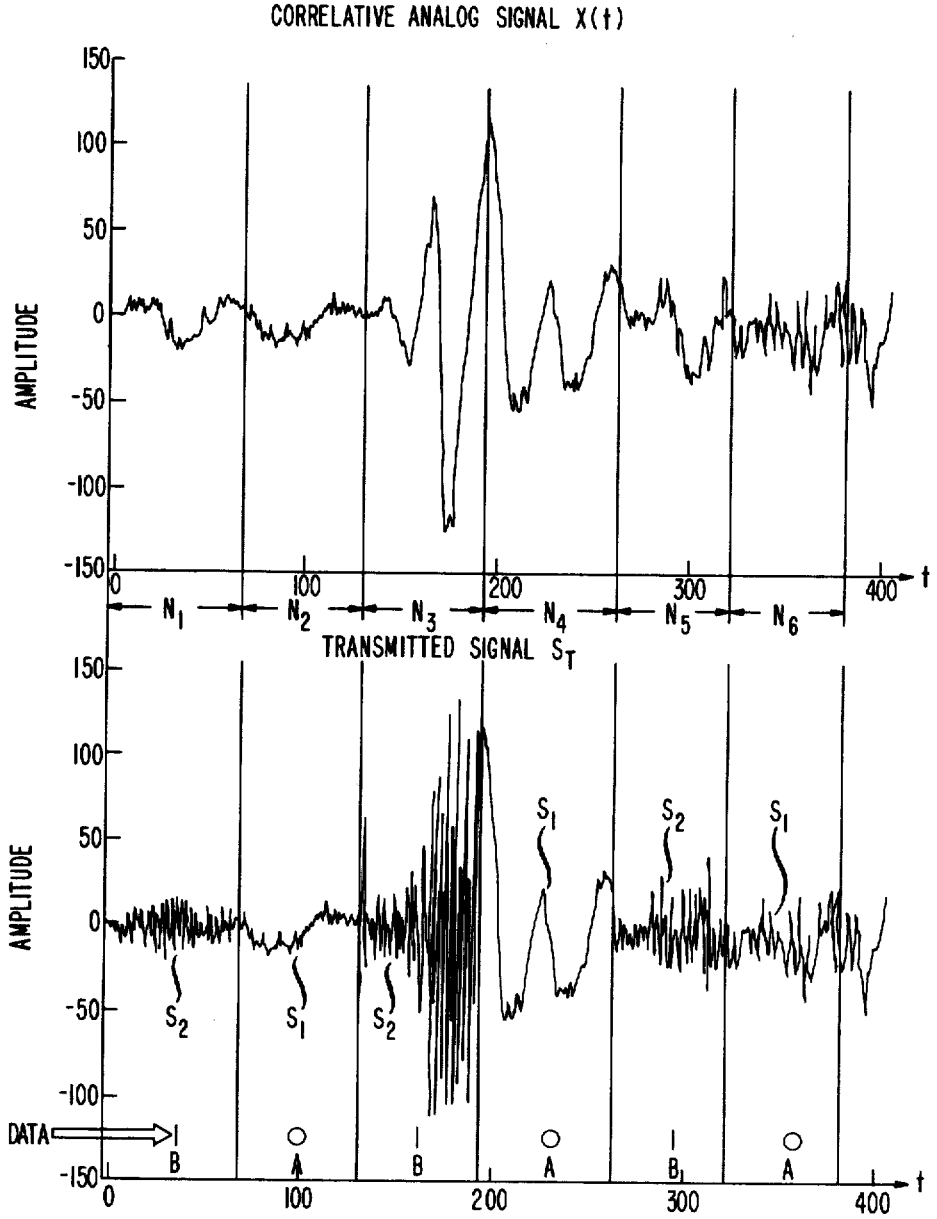
FIG. 6 illustrates the various input and output waveforms associated with the transmitter illustrated in FIG. 5.

An exemplary output sequence $S_T$ formed in accordance with the present invention and its associated analog signal x(t) and data stream $\{d_k\}$ are illustrated in FIG. 6 for the condition that control signal y is equal to a logical 1. In this example, the analog signal x(t) is speech, bandlimited to 3.4 KHz. Thus, sampler 70 operates at 8 KHz and buffer 72 sequentially groups samples in blocks of 64 samples for processing. In this illustration, six blocks of samples, labeled $N_1$ through $N_6$ are shown as a function of time. The exemplary scrambled data sequence illustrated in FIG. 6 comprises the set {1, 0, 1, 0, 1, 0}, where each data bit (as shown in FIG. 6) is associated in a one-to-one relationship with a separate one of the six blocks of N speech samples. In this illustration, the system thresholds are satisfied, namely $y = 1$, allowing data to be transmitted. As seen by reference to FIG. 6, each time the data is equal to a logical 0, the associated nonscrambled block of N samples, $S_1$, is transmitted, in this case, blocks $N_2$, $N_4$ and $N_6$. The scrambled sequence $S_2$, therefore, is transmitted for speech signal blocks $N_1$, $N_3$ and $N_5$, which are associated with a data bit equal to a logical 1. The associated position of switch 56 (A or B) is also illustrated in FIG. 6.

Figure 7:
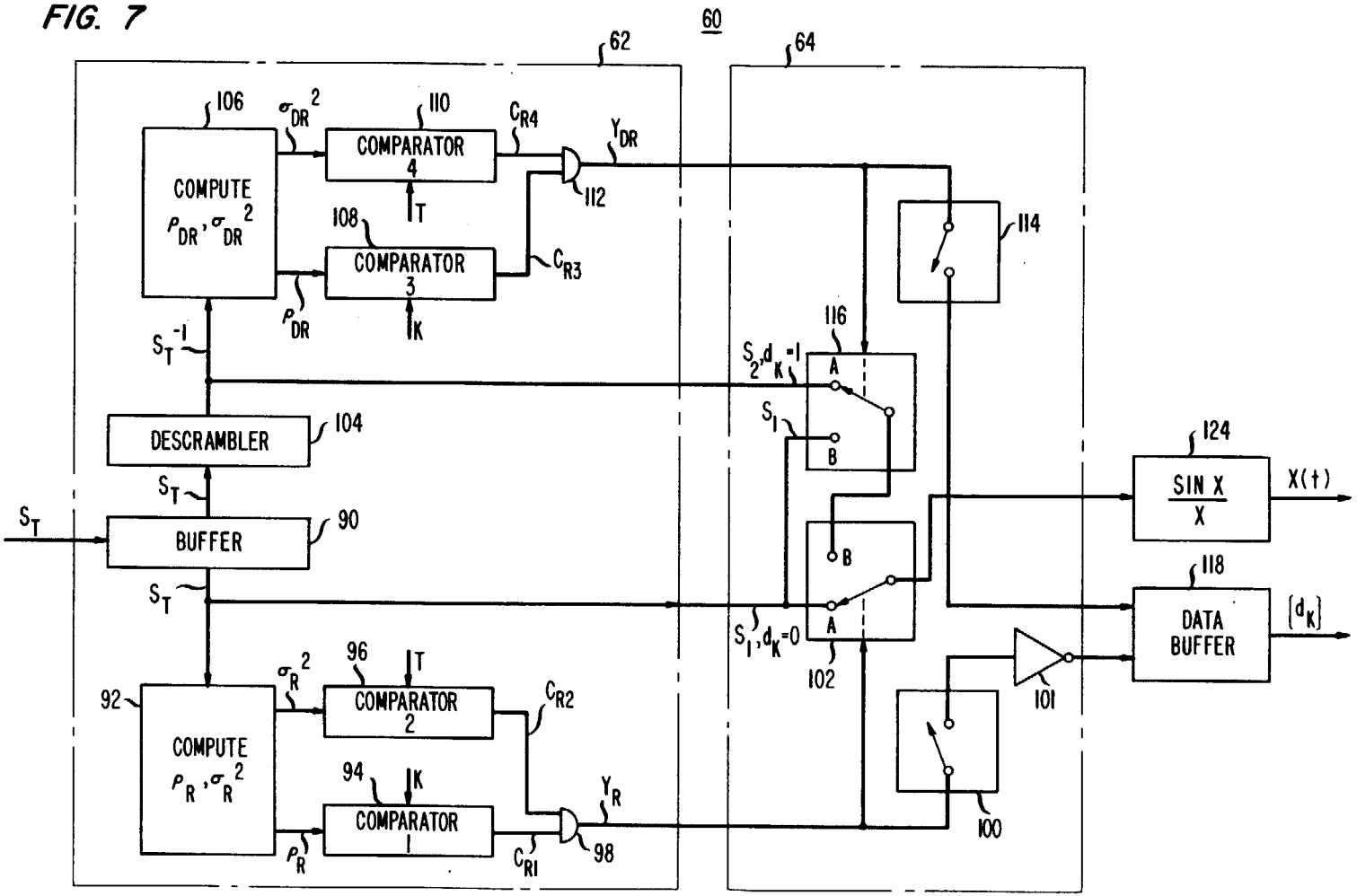
FIG. 7 contains a preferred embodiment of an exemplary receiver which may be employed in the system of FIG. 4 in accordance with the present invention.

As discussed hereinabove in association with FIG. 4, the sequence $S_T$ produced by transmitting 50 travels through the communicaion medium and is subsequently processed through receiver 60 to be reconverted into the original analog signal x(t) and the original data stream $\{d_k\}$, where an exemplary receiver arrangement, which is a preferred embodiment formed in accordance with the present invention, is illustrated in detail in FIG. 7. As seen by reference to FIG. 7, the receiver comprises many components similar to those included in the transmitter illustrated in FIG. 5, where this similarity is necessary to ensure the accurate recovery of analog signal x(t) and data stream $\{d_k\}$. In operation, the received samples are stored in a buffer 90 until the received sequence $S_T$ is available. When combined signal processor 62 is ready, the N samples comprising the received sequence $S_T$ are accepted for processing. An examplary block of N samples of the received sequence $S_T$ is subsequently applied as an input to a first computation means 92 which, in a manner similar to that described hereinabove in association with computation means 76, and in accordance with equations (4) and (5), produces as simultaneous outputs a received correlation coefficient $\rho_R$ and a received power value $\sigma_R^2$, associated with the exemplary block of N samples of the received sequence $S_T$. Correlation coefficient $\rho_R$ produced by computation means 92 is subsequently applied as an input to a first comparator 94, which compares $\rho_R$ to the same predetermined constant K associated with first comparator 78 of transmitter 50, as illustrated in FIG. 5. First comparator 94 produces as an output a control signal $C_{R1}$ in accordance with the following relation between correlation coefficient $\rho_R$ and constant K, $$C_{R1} = \begin{cases} \text{logical 1; if } \rho_R \geqq K \\ \text{logical 0; if } \rho_R < K \end{cases} \quad (10)$$

In a similar manner, power value $\sigma_R^2$ is applied as an input to a second comparator 96, which compares power value $\sigma_R^2$ to the same predetermined constant T associated with second comparator 80 of FIG. 5 to produce as an output a control signal $C_{R2}$ where $$C_{R2} = \begin{cases} \text{logical 1; if } \sigma_R^2 \geqq T \\ \text{logical 0; if } \sigma_R^2 < T \end{cases} \quad (11)$$

The control signals $C_{R1}$ and $C_{R2}$ are subsequently applied as separate inputs to an AND gate 98 which produces as an output a gate control signal $y_R$ represented by the logical equation $$y_R = C_{R1}C_{R2}. \quad (12)$$

Therefore, gate control signal $y_R$ will equal a logical 1 if and only if both $\rho_R \geqq K$ ($C_{R1}=1$) and $\sigma_R^2 \geqq T$ ($C_{R2}=1$), indicating, therefore, that the original sequence $S_1$ was transmitted. Therefore, by reference to Table A, if the sequence $S_1$ was received and $y_R$ (which may be assumed to be equal to y, the control signal produced by AND gate 82 of FIG. 6) is equal to a logical 1, the associated data bit is assumed to be equal to a logical 0. Hence, the receiver has recovered both the original sequence $S_1$ and a data bit of the data sequence $\{d_k\}$ equal to a logical 0. Gate control signal $y_R$ equal to a logical 1, therefore, will activate a switch 102 (included in switch 64 of FIG. 4) to connect by way of a terminal A the sequence $S_1$ to the output line. Gate control signal $y_R$ equal to a logical 1 will also activate a switch 100 to connect the signal $y_R$ to an inverter 101, which will transform $y_R$ into a logical 0, the associated received data bit. Following the inversion, the data bit is applied as a first input to, and is stored in, a data buffer 118. This result is illustrated in Table B, which contains all possible values of control signal $y_R$ and a control signal $y_{DR}$ at the output of an AND gate 112 (which is of no import as long as $y_R=1$, and will be described in greater detail hereinafter in association with the condition $y_R=0$), and both the received signal and data bit associated therewith.

TABLE B

| $Y_R$ | $Y_{DR}$ | Received Signal | Received Data |
|---|---|---|---|
| 1 | 1 or 0 | $S_1$ | 0 |
| 0 | 1 | $S_2$ | 1 |
| 0 | 0 | $S_1$ | None |

If gate control signal $y_R$ is equal to a logical 0, instead of a logical 1, either $\rho_R < K$ or $\sigma_R^2 < T$ and no determination can be made without further investigation as to which signal and data bit were transmitted. Therefore, in accordance with the present invention, if $y_R=0$, switch 100 is not activated, switch 102 is positioned at terminal B, and the received signal $S_T$ is processed through a descrambling arrangement illustrated in FIG. 7 to ascertain the identity of both the signal and the data bit. Initially, the received sequence $S_T$ is passed through a descrambler 104 which performs the conjugate operation of scrambler 74 illustrated in FIG. 5 and associated with equation (3) to produce as an output a frequency inverted version of $S_T$, defined as $S_T^{-1}$. Therefore, if the sequence $S_T$ received by receiver 60 is the scrambled sequence $S_2$ (indicating the transmission of a data bit equal to a logical 1), the output of descrambler 104, $S_T^{-1}$, will be the original sequence $S_1$. Alternatively, if the received sequence $S_T$ is the original correlated sequence $S_1$ (indicating the absence of data transmission), the output of descrambler 104, $S_T^{-1}$, will be the uncorrelated sequence $S_2$. Therefore, the identity of $S_T$ when $y_R$ is equal to a logical 0 may be ascertained by subjecting the sequence $S_T^{-1}$ to a similar comparison process as described hereinbefore in association with the sequence $S_T$.

In particular, the output sequence $S_T^{-1}$ of descrambler 104 is applied as an input to a second computation means 106 which, in a manner similar as that described hereinabove in association with first computation means 92 and equations (4) and (5), produces as simultaneous outputs a descrambled received correlation coefficient $\rho_{DR}$ and a descrambled received power value $\sigma_{DR}^2$. Correlation coefficient $\rho_{DR}$ is subsequently applied as an input to a third comparator 108, which compares the value of $\rho_{DR}$ to the above-defined constant K and produces as an output a gate control signal $C_{R3}$, where $$C_{R3} = \begin{cases} \text{logical 1; } \rho_{DR} \geqq K \\ \text{logical 0; } \rho_{DR} < K \end{cases} \quad (14)$$

In a similar manner, power value $\sigma_{DR}^2$ produced by computation means 106 is applied as an input to a fourth comparator 110, which compares the value of $\sigma_{DR}^2$ to the above-defined constant T and produces as an output a gate control signal $C_{R4}$, where $$C_{R4} = \begin{cases} \text{logical 1; } \sigma_{DR}^2 \geqq T \\ \text{logical 0; } \sigma_{DR}^2 < T \end{cases} \quad (15)$$

The control signals $C_{R3}$ and $C_{R4}$ are subsequently applied as separate inputs to an AND gate 112 which produces the above-mentioned control signal $y_{DR}$ in accordance with the Boolean relation $$y_{DR}=C_{R3}C_{R4}. \quad (16)$$

Therefore, $y_{DR}$ will equal a logical 1 if and only if both $\rho_{DR} \geqq K$ and $\sigma_{DR}^2 \geqq T$, indicating that the sequence $S_T^{-1}$ produced by descrambler 104 is the original sequence $S_1$. Therefore, the sequence $S_T$ corresponds to the scrambled sequence $S_2$ with a data bit equal to a logical 1 associated therewith.

Control signal $y_{DR}$ equal to a logical 1 activates a gate 114 which in turn activates a switch 116 (included with switch 102 in switch 64) to connect the sequence $S_T^{-1}$ (equal to $S_1$) by way of a terminal A to the output line, allowing the receiver to recover the original correlated sequence $S_1$. Control signal $y_{DR}$ equal to a logical 1 also activates a switch 114 which connects control signal $y_{DR}$ to a second input of buffer 118, thereby indicating the reception of a data bit equal to a logical 1. By default, therefore, if $y_{DR}$ is equal to a logical 0, switch 116 is connected to a terminal B and the original received sequence $S_T$ (equal to $S_1$) is connected to the output. Since the received sequence $S_T$ corresponds to the original sequence $S_1$, and control signal $y_{DR}$ is equal to a logical 0, no data bit is associated with this particular received sequence. The above-described cases for both $y_{DR}=1$ and $y_{DR}=0$ are summarized for reference purposes in Table B.

In summary, it is observed that if conditions are not correct for the conveyance of data (y=0), or if a logical 0 is transmitted, the original sequence is dispatched without being scrambled. Only when a logical 1 is transmitted is scrambling performed and the scrambled analog sequence is transmitted.

The original analog signal x(t) is recovered from the sequence $S_1$ by passing this sequence through a filtering means 124, which in this example is the (sinx/x) function. Filtering means 124 functions to "broaden" the duration of each element in the sequence and thereby form a continuous-time signal, in this case, analog signal x(t). It is to be understood that the components forming receiver 60 illustrated in FIG. 7 are readily available, where specifically descrambler 104, computation means 92 and 106, and weighting means 84 may be implemented by, for example, a microprocessor arrangement.

Figure 8:
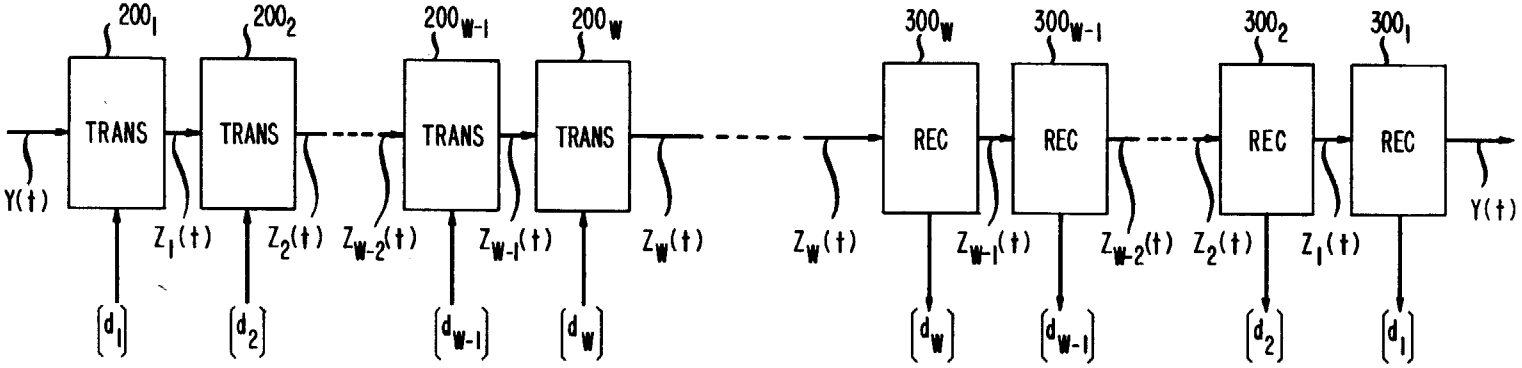
FIG. 8 illustrates an alternative embodiment of the present invention including a plurality of cascaded transmitters and a plurality of cascaded receivers.

An alternative arrangement of the present invention which is capable of simultaneously transmitting W data elements with a single relatively coherent signal y(t) is illustrated in FIG. 8. As shown, the arrangement comprises a plurality of W cascaded transmitters $\mathbf{200_1}$–$\mathbf{200_W}$ and a plurality of W cascaded receivers $\mathbf{300_1}$14 $\mathbf{300_W}$, where an exemplary transmitter $\mathbf{200_1}$, and an exemplary receiver $\mathbf{300_1}$, may comprise any of the arrangements illustrated in the previous figures. In operation, the original relatively coherent signal y(t) is applied as a first input to transmitter $\mathbf{200_1}$, where the second input is a first data sequence $\{d_1\}$. The output of transmitter $\mathbf{200_1}$, denoted $z_1(t)$, is, in accordance with the present invention, a scrambled sequence related to both the current value of an element or elements of first data sequence $\{d_1\}$ and the original signal y(t). Signal $z_1(t)$, although a scrambled sequence, may retain a sufficient level of coherence to allow the scrambling process to be repeated, and if that is the case, may be applied as a first input to transmitter $\mathbf{200_2}$, where the second input to transmitter $\mathbf{200_2}$ is an element or elements of a second data sequence $\{d_2\}$. The output of transmitter $\mathbf{200_2}$, denoted $z_2(t)$, is, therefore, a scrambled sequence which is related to both the first and second data sequences and the original signal y(t). For as long as the output signal from an individual transmitter $\mathbf{200_i}$ retains some degree of coherence, the scrambling process may be repeated, and in general, may be applied W times in succession, resulting in the transmission of W separate data sequences with the original signal y(t) in the form of a scrambled signal $z_W(t)$. The value of W is associated with a signal $z_W(t)$ whose statistical properties can no longer be exploited for the conveyance of data by the method previously described.

At the receiving end, the W scrambling processes utilized by the transmitter are applied in reverse as descrambling processes, as illustrated in FIG. 8. As shown, the received sequence $z_W(t)$ is applied as an input to a first receiver $\mathbf{300_W}$ and produces as separate outputs both the $W^{th}$ data sequence $\{d_W\}$ and as scrambled sequence $z_{W-1}(t)$, which were the separate inputs to the associated transmitter $\mathbf{200_W}$. Scrambled sequence $z_{W-1}(t)$ is subsequently applied as an input to receiver $\mathbf{300_{W-1}}$ which performs the inverse process of transmitter $\mathbf{200_{W-1}}$ to produce as separate outputs both data sequence $\{d_{W-1}\}$ and scrambed sequence $z_{W-2}(t)$. The descrambling process is continued in a like manner until finally scrambled sequence $z_1(t)$ is applied as an input to receiver $\mathbf{300_1}$ which produces as separate outputs both the first data sequence $\{d_1\}$ and the original signal y(t). Therefore, in accordance with the present invention, a cascaded arrangement of W transmitters and W receivers as illustrated in FIG. 8 is capable of simultaneously transmitting and subsequently recovering W unique data sequences along with a relatively correlated signal y(t).

In conclusion, a method and apparatus for simultaneously transmitting an analog message signal and digital data is disclosed whereby the message and the data can be transmitted simultaneously over the channel by using scrambling strategies. The scrambling key becomes the data to be transmitted and the receiver adopts the role of code-breaker. Every time the receiver correctly guesses the key and breaks the code, it recovers both the message and the data. The scrambling process is therefore a catalyst which enables the data to be transmitted.

I claim:

1. In a simultaneous transmission system for data and analog signals:

a transmitter (10) capable of receiving as separate inputs an analog signal (x(t)) and a binary data stream ($\{d_k\{$) comprising a plurality of data bits and producing as an output a coded sequence ($S_T$) related to both the input analog signal and the binary data stream; and a receiver (20) capable of receiving as an input the coded sequence produced by the transmitter and transforming the coded sequence back into the original analog signal and the original binary data stream characterized in that the transmitter is continuously responsive to sequences of n elements ($d_i$) of the data stream, where each separate sequence comprises one of a set of $2^n$ unique data sequences, said transmitter comprising a scrambler (16) responsive to the input signal (x(t)) capable of performing a plurality of M unique scrambling processes on said input signal for producing M unique scrambled sequences ($S_1$, $S_2$, . . . $S_M$) related to the input signal, where $M=2^n$; and means (18)for pairing a separate one of said $2^n$ unique data sequences with a separate one of said M scrambled sequences related to said input signal produced by said scrambler and dispatching a separate scrambled sequence ($S_i$) of said M unique scrambled sequences which is paired with a current data sequence ($d_i$) of said data stream as the coded output sequence ($S_T$) of said transmitter; and the receiver comprises a descrambler (24) responsive to the received coded sequence ($S_T$) for performing a plurality of M unique descrambling process related in a one-to-one manner with said plurality of M unique scrambling processes performed by said scrambler of said transmitter, said descrambler capable of producing a plurality of M descrambled sequences ($S_{T1-STM}$), and a detector (26, 30, 32) responsive to said plurality of M descrambled sequences produced by said descrambler for determining which descrambled sequence of said plurality of M descrambled sequences was dispatched by said transmitter by employing predetermined statistical properties of the input signal to said transmitter, and producing both said descrambled sequence and the data sequence associated therewith a separate outputs, said data sequence being an output of said receiver; and filtering means (34) responsive to said descrambled sequence produced by said detector for producing the original analog signal as an output of said receiver.

2. A simultaneous transmission system formed in accordance with claim 1 characterized in that the transmitter comprises a plurality of W cascaded transmitters (200$_1$-200$_W$), each cascaded transmitter coupled to receive a separate one of a plurality of W distinct data sequences ($\{d_1\}$-$\{d_w\}$) forming the data stream ($\{d_k\}$), said plurality of W cascaded transmitters capable of producing as an output a coded sequence ($z_w(t)$) related to both the input analog signal and said plurality of W distinct data sequences, and the receiver comprises a plurality of W cascaded receivers (300$_1$-300$_W$), each cascaded receiver capable of producing as an output a separate one of said plurality of W distinct data sequences.

3. A transmission system in accordance with claims 1 or 2 characterized in that the transmitter comprises sampling means (12) responsive to the input signal for producing an output sequence related thereto; and a buffer (14) responsive to the output of said sampling means for continuously dispatching N-length sequences related to said output sequence of said sampling means; and the scrambler comprises key generating means (44) responsive sequentially to a current data sequence ($d_i$) from the data stream for generating a plurality of M unique N-length scrambling sequences ($\{K_1\}$-$\{K_M\}$) associating said plurality of M unique N-length sequences with said plurality of $2^n$ unique data sequences in a one-to-one relationship, and producing as an output a scrambled sequence ($\{S_i\}$) associated with said current data sequence ($d_i$).

4. A transmission system formed in accordance with claims 1 or 2 characterized in that the detector comprises a plurality of M correlation coefficient generators (30$_1$-30$_M$), each correlation coefficient generator responsive to a separate one of the plurality of M descrambled sequences produced by said plurality of M descramblers for generating a correlation coefficient ($\rho$) associated therewith, said plurality of correlation coefficient generators thereby producing a plurality of correlation coefficients ($\rho_1$-$P_M$);

a comparator (32) capable of receiving as separate inputs said plurality of M correlation coefficients generated by said plurality of M correlation coefficient generators, for comparing said correlation coefficients to each other in determining a largest correlation coefficient ($\rho_i$) and producing as an output the descrambled sequence ($S_i$) and related data sequence ($d_i$) associated with said largest correlation coefficient of said plurality of M correlation coefficients.

5. A transmission system formed in accordance with claim 3 characterized in that the detector comprises a plurality of M correlation coefficient generators (30$_1$-30$_M$), each correlation coefficient generator responsive to a separate one of the plurality of M descrambled sequences produced by said plurality of M descramblers for generating a correlation coefficient ($\rho$) associated therewith, said plurality of correlation coefficient generators thereby producing a plurality of correlation coefficients ($\rho_1$-$\rho_M$);

a comparator (32) capable of receiving as separate inputs said plurality of M correlation coefficients generated by said plurality of M correlation coefficient generators, for comparing said correlation coefficients to each other to determine a largest correlation coefficient ($\rho_i$) and producing as an output the descrambled sequence ($S_i$) and related data sequence ($d_i$) associated with said largest correlation coefficient of said plurality of M correlation coefficients.

6. A simultaneous transmission system formed in accordance with claim 1 characterized in that the transmission system incudes a single scrambler and a single descrambler for the transmission and reception of a single data bit associated with the analog signal, the transmitter including:

an analog signal processor (52) responsive to the analog signal for producing as simultaneous outputs a nonscrambled sequence ($S_1$) related to said analog signal, a scrambed sequence ($S_2$) related to said analog signal, and a control signal (y), where said control signal comprises a first value (1) if said analog signal comprises both a correlation coefficient ($\rho$) and a power value ($\sigma_x^2$) which are equal to or greater than separate ones of a pair of predetermined threhold levels (K,T) and a second value (0) if said analog signal does not exceed said predetermined thresholds;

a gate (54) responsive to both said control signal produced by said analog signal processor and a binary data bit of the binary data stream for producing a gate control signal (y'), where said gate control signal comprises a first value (1) if both said control signal and said data bit comprise their respectively associated first value, and comprises a second value (0) if either one of said control signal and said data bit comprise their respectively associated second value; and a switch (56) capable of receiving as separate inputs said nonscrambled and scrambled sequences produced by said analog signal processor and said gate control signal produced by said gate for producing as the coded output sequence of said transmitter, said scrambled sequence when said gate control signal comprises its associated first value and producing said nonscrambled sequence when said gate control signal comprises its associated second value; and the receiver includes:

a combined signal processor (62) responsive to said coded output sequence produced by said transmitter for producing as simultaneous outputs a first output sequence ($S_2$, $d_k=1$) corresponding to said scrambled sequence and a data bit of said first value, a second output sequence $S_1$,$d_k=0$) corresponding to said nonscrambled sequence and a data bit of said second value, a third output sequence ($S_1$) corresponding to said nonscrambled sequence only, and a first ($y_R$) and a second ($y_{DR}$) receiver control signal which in combination can comprise one set of a predetermined first (1,x), second (0.1) and third (0,0) alternative set of values ($y_R$,$y_{DR}$) related to known statistical properties of said coded sequence produced by said transmitter (where x may be equal to 0 or 1); and a switch (64) responsive to said first, second, and third output sequences and said first and second receiver control signls produced by said combined signal processor for producing as an output of said receiver said first output sequence if said first and second receiver control signal comprise said first alternative set of values, said second output sequence if said first and second receiver control signals comprise said second alternative set of values, and said third output sequence if said first and second receiver control signals comprise said third alternative set of values.

7. A transmitter (50) capable of receiving as separate inputs an analog signal x(t) and a binary data stream ($\{d_k\}$) comprising a plurality of data bits of either a first or a second value and producing as an output a coded sequence ($S_T$) related to both the input correlative analog signal and the binary data stream characterized in that the transmitter includes:

an analog signal processor (52) responsive to the analog signal for producing as simultaneous outputs a nonscrambled sequence ($S_1$) corresponding to said analog signal, a scrambled sequence ($S_2$) related to said analog signal, and a control signal (y), where said control signal comprises a first value (1), if said analog signal comprises both a correlation coefficient ($\rho$) and a power value ($\sigma_x^2$) which are equal to or greater than separate ones of a pair of predetermined threshold levels (K,T) and a second value (0), if said analog signal does not exceed said predetermined thresholds;

a gate (54) responsive to said control signal produced by said analog processor and a binary data bit of the binary data stream for producing a gate control signal (y'), where said gate control signal comprises a first value (1) if both said control signal and said data bit comprise their respectively associated first value, and comprises a second value (0) if either one of both said control signal and said data bit comprise their respectively associated second value; and a switch (56) capable of receiving as separate inputs said nonscrambled and scrambled sequences produced by said analog signal processor and said gate control signal produced by said gate for producing as the coded sequence output of said transmitter said scrambled sequence when said gate control signal comprises its associated first value and said nonscrambled sequence when said gate control signal comprises its associated second value.

8. A transmitter formed in accordance with claims 6 or 7 characterized in that the analog signal processor comprises sampling means (70) capable of sampling the analog signal at a predetermined rate t and producing as an output a nonscrambled sequence ($S_1$) comprising sampled elements of said analog signal;

scrambling means (74) responsive to the nonscrambled sequence of said sampling means for altering predetermined elements of said sequence and producing as an output a scrambled sequence ($S_2$) related thereto; and control means (76, 78, 80, 82) being responsive to said nonscrambled sequence for generating a correlation coefficient ($\rho$) and a power value ($\rho_x^2$) associated with said nonscrambled sequence and also for generating the analog processor output control signal (y) which comprises its associated first value (1) when each of said correlation coefficient and said power value are equal to or exceed a separate predetermined first (K) and second (T) threshold level, respectively, and comprises its associated second value (0) when either one of said correlation coefficient and said power value are less than their respective first and second predetermined threshold levels.

9. A transmitter formed in accordance with claim 8 characterized in that the control means comprises computation means (76) responsive to said nonscrambled sequence for producing a correlation coeffieient ($\rho$) and a power value $\sigma_x^2$) associated therewith;

a first comparator (78) responsive to said correlation coefficient produced by said computation means for comparing said correlation coefficient to said predetermined correlation coefficient threshold level (K) and producing an output control signal ($C_1$), which comprises a first value (1) if said correlation coefficient is greter than or equal to said predetermined correlation coefficient threshold level and comprises a second value (0) if said correlation coefficient is less than said predetermined correlation coefficient threshold level;

a second comparator (80) responsive to said power value produced by said computation means for comparing said power value to said predetermined power value threshold level (T) and producing an output control signal ($C_2$), which comprises a first value (1) if said power value is greater than or equal to said predetermined power value threshold level and comprises a second value (0) if said power value is less than said predetermined power value threshold level; and a combiner (82) responsive to said output control signals of both said first and second comparators for combining said output control signals to produce the analog signal processor control signal (y), comprising a first value (1) if both said first comparator output control signal and said second comparator output control signal comprise their respective first values, and comprises a second value (0) if either one of both said first comparator output control signal and said second comparator output control signal comprises its associated second value.

10. A receiver (60) capable of recovering both a correlative analog signal (x(t)) and a binary data stream ($\{d_k\}$) from a coded sequence ($S_T$) representative of a combination of the correlative analog signal and the binary data stream characterized in that the receiver includes:

a combined signal processor (62) responsive to the coded input sequence for producing as simultaneous outputs a first output sequence ($S_2$, $d_k=1$) corresponding to a scrambled sequence and a data bit of a first value, a second output sequence ($S_1$,$d_k=0$) corresponding to a nonscrambed sequence and a data bit of a second value, a third output sequence ($S_1$) corresponding to said nonscrambled sequence only, and a first ($y_R$) and a second ($y_{DR}$) receiver control signal ($y_R$, $y_{DR}$) which comprise one set of a first (1,x), second (0.1), and third (0,0) alternative set of values ($y_R$, $Y_{DR}$) related to known statistical properties of said coded sequence where x is equal to either 1 or 0; and a switching means (64) responsive to said first, second, and third output sequences of said first and second receiver control signals produced by said combined signal processor for producing as an output of said receiver said first output sequence if said first and second receiver control signal comprise said first alternative set of values, said second output sequence if said first and second receiver control signals comprises a second alternative value, and said third output sequence if said first and second receiver control signals comprise said third alternative set of values.

11. A receiver formed in accordance with claims 6 or 10 characterized in that the combined signal processor includes first control means (92, 94, 96, 98) being responsive to said coded input sequence for generating a receive correlation coefficient ($\rho_R$) and a receive power value ($\sigma_R^2$) associated with said coded input sequence and for generating the first receiver control signal ($y_R$) which comprises a first value (1) when each of said receive correlation coefficient and said receive power value are equal to or exceed a separate predetermined first (K) and second (T) threshold level, respectively, and comprises a second value (0) when either one of said receive correlation coefficient and receive power value are less than their respective first and second predetermined threshold levels;

descrambling means (104) responsive to each coded sequence for altering predetermined elements of said coded sequence and producing as an output a descrambled sequence ($S_T^{-1}$) related thereto;

second control means (106, 108, 110, 112) being responsive to said descrambled sequence produced by said descrambling means for generating a descrambled receive correlation coefficient ($\rho_{DR}$) and a descrambled receive power value ($\sigma_{DR}^2$) associated with said descrambled sequence and for generating the second receiver control signal ($y_{DR}$) which comprises a first value (1) when each of said descrambled receive correlation coefficient and said descrambled receive power value are equal to or exceed a separate predetermined first (K) and second (T) threshold level, respectively, and comprising a second value (0) when either one of said descrambled receive correlation coefficient and said descrambled receive power value are less than their respective first and second predetermined threshold levels.

12. A receiver formed in accordance with claim 11 characterized in that the first control means comprises computation means (92) responsive to each coded input sequence for producing the receive correlation coefficient ($\rho_R$) and the receive power value ($\sigma_R^2$) associated therewith;

a first comparator (94) responsive to said receive correlation coefficient produced by said computation means for comparing said receive correlation coefficient to the predetermined correlation coefficient threshold level (K) and producing an output control signal ($C_{R1}$) which comprises a first value (1) if said receive correlation coefficient is greater than or equal to said predetermined correlation coefficient threshold level and comprises a second value (0) if said receive correlation coefficient is less than said predetermined correlation coefficient threshold level;

a second comparator (96) responsive to said receive power value produced by said computation means for comparing said power value to the predetermined power value threshold level (T) and producing an output control signal ($C_{R2}$) which comprises a first value (1) if said receive power value is greater than or equal to said predetermined power value threshold level and comprises a second value (0) if said receive power value is less than said predetermined power value threshold level; and a combiner (98) responsive to said output control signals of both said first and second comparators for combining said output control signals to produce the first receiver control signal ($y_R$), which comprises a first value (1) if both said first comparator output control signal and said second comparator output control signal comprise their associated first values and comprises a second value (0) if either one of both said first and second comparator output control signals comprises its associated second value; and the second control means comprises computation means (106) responsive to each descrambled sequence produced by said descrambling means for producing the descrambled receive correlation coefficient ($\rho_{DR}$) and the descrambled receive power value ($\sigma_{DR}^2$) associated therewith;

a first comparator (108) responsive to said descrambled receive correlation coefficient produced by said second computation means for comparing said descrambled receive correlation coefficient to said predetermined correlation coefficient threshold level and producing an output control signal ($C_{R3}$) which comprises a first value (1) if said descrambled receive correlation coefficient is greater than or equal to said predetermined correlation coefficient threshold level and comprises a second value (0) if said descrambled receive correlation coefficient is less than said predetermined correlation coefficient threshold level;

a second comparator (110) responsive to said descrambled receive power value produced by said second computation means for comparing said power value to said predetermined power threshold level and producing an output control signal ($C_{R4}$), which comprises a first value (1) if said power value is greater than or equal to said predetermined power value threshold level and comprises a second value (0) if said power value is less than said predetermined power value threshold level; and a combiner (112) responsive to said output control signals of both said first and second comparators for combining said output control signals to produce the second receiver control signal ($y_{DR}$), where said second receiver control signal comprises a first value (1) if both said first and second comparator output control signals comprise their associated first values and comprises a second value (0) if either one of both said first and second comparator output control signals comprises its associated second value.

13. A receiver formed in accordance with claim 12 characterized in that the switching means comprises a first switch (116) including a first input terminal (A) coupled to receive said descrambled sequence produced by said descrambling means, a second input terminal (B) coupled to receive said coded sequence, a third input terminal coupled to receive the second receiver control signal produced by said second control means combiner and an output terminal, where said first input terminal is connected to the output terminal when said second receiver control signal comprises its associated first value and said second input terminal is connected to said output terminal when said second receiver control signal comprises its associated second value;

a second switch (102) including a first input terminal (A) coupled to receive said coded sequence, a second input terminal (B) coupled to said output terminal of said first switch, a third input terminal coupled to receive the first receiver control signal produced by said first control means combiner and an output terminal coupled to the output of said receiver, where said first input terminal is connected to the output terminal when said first receiver control signal comprises its associated first value and said second input terminal is connected to said output terminal when said first receiver control signal comprises its associated second value;

a first data switch (114) responsive to said second receiver control signal for producing an output data bit equal to a logical 1 when said second receiver control signal comprises its associated first value;

a second data switch (100) responsive to said first receiver control signal for producing an output signal equal to a logical 0 when said first receiver control signal comprises its associated first value; and an inverter (101) responsive to the output signal produced by said second data switch for producing an output data bit equal to a logical 0.

14. A method of simultaneously achieving secure transmission of an analog signal (x(t)) and an n-length data sequence ($d_i$) from a data stream ($\{d_k\}$), the method comprising the steps of:

a. multiplexing the analog signal and the digital data stream to form a coded sequence ($S_T$), b. transmitting the coded sequence, c. receiving the coded sequence; and d. demultiplexing the received coded sequence to recover both the analog signal and the digital data stream, characterized in that the method comprises the further steps of e. in performing step (a), performing the steps of:

1. scrambling the analog signal utilizing M unique scrambling processes, where $M=2^n$, to form M unique scrambled sequences ($S_1$–$S_M$), 2. associating the M scrambled sequences formed in step (e)(1) in a one-to-one relationship with a set of the $2^n$ possible combinations of the n-length data sequences that could be transmitted, and 3. defining the coded sequence ($S_T$) as one of the M sequences of step (e)(1) associated in step (e)(2) with a current n-length data sequence desired to be transmitted; and f. in performing step (d), performing the steps of:

1. simultaneously descrambling the received coded sequence by M unique processes, each separate process related to the inverse of a separate one of the M unique scrambling processes in step (e)(1) to form M descrambled sequences ($S_{T1}$–$S_{TM}$), and 2. comparing known statistical coherence properties of the M descrambled sequences formed in step (f)(1) and producing as separate outputs the most coherent descrambled sequence and the n-length data element associated therewith.

15. The method according to claim 14 characterized in that the method comprises the further steps of:

g. in performing step (f)(2), performing the steps of 1. determining the correlation coefficient related to each descrambled sequence formed in step (f)(1);

2. comparing said correlation coefficients formed in step (g)(1) to each other and identifying the unique descrambled sequence associated with the largest valued correlation coefficient;

3. pairing the unique descrambled sequence identified in step (g)(2) with its associated n-length data sequence; and 4. producing the descrambled sequence and the n-length data sequence of steps (g)(3) and (g)(4) as separate outputs of the receiver.

16. A method of achieving simultaneous transmission of an analog signal (x(t)) and a single data bit from a digital data stream ($\{d_k\}$) comprising the steps of:

a. multiplexing the correlative analog signal and the data bit from the digital data stream to form a coded sequence ($S_T$), and b. transmitting the coded sequence characterized in that the method comprises the further steps of:

c. in performing step (a), performing the steps of:

1. processing the correlative analog signal to form a first output sequence ($S_1$), a second output sequence ($S_2$) which is a scrambled version of the first output sequence, and a control signal (y) comprising either one of a first and a second value, 2. pairing data bits of the data stream with said control signal of step (c)(1) when said control signal comprises its associated first value and producing an output signal comprising a first value when the paired data bit is a logical 1 and a second value when the paired data bit is a logical 0;

3. forming a switch control signal (Y') which comprises a first value when either one of said control signal of step (c)(1) and said output signal of step (c)(2) comprises its associated second value, and comprises a second value when the output signal of step (c)(2) comprises its associated first value; and 4. transmitting the first output sequence of step (c)(1) when the switch control signal of step (c)(3) comprises its first value and transmitting the second output sequence of step (c)(1) when the switch control signal of step (c)(3) comprises its second value to form the coded sequence of step (a).

17. The method according to claim 16 characterized in that the method comprises the further steps of:

d. in performing step (c)(1), performing the steps of:

1. sampling the correlative analog signal at a predetermined rate to form the first output sequence ($S_1$);

2. scrambling the result of step (d)(1) to form the second output sequence ($S_2$);

3. computing a correlation coefficient (p) and a power value ($\rho_x^2$) relative to the first output sequence formed in step (d)(1); and 4. comparing both the correlation coefficient formed in step (d)(3) to a predetermined correlation threshold (K), and the power value formed in step (d)(3) to a predetermined power threshold (T) and producing the control signal of step (c)(1) which comprises its associated first value if both the correlation coefficient and the power value formed in step (d)(3) are greater than or equal to their associated predetermined thresholds and comprises its associated second value if either one of both the correlation coefficient and the power value formed in step (d)(3) are less than their associated predetermined thresholds.

18. A method of achieving reception of a coded sequence ($S_T$) related to a multiplexed version of a correlative analog signal (x(t)) and a data bit from a digital data stream ($\{d_k\}$) and recovering both the analog signal and the data bit from the digital data stream therefrom comprising the steps of:

a. receiving the coded sequence; and b. demultiplexing the received coded sequence to recover both the correlative analog signal and the data bit from the digital data stream characterized in that the method comprises the further steps of:

c. in performing step (b), performing the steps of:

1. processing the received coded sequence to produce a first output sequence ($S_{2,1}$) related to a scrambled sequence ($S_2$) and a data bit equal to a logical one, a second output sequence ($S_{1,0}$) related to a nonscrambled sequence ($S_1$) and a data bit equal to a logical zero, a third output sequence ($S_1$) related only to the nonscrambled sequence, a first control signal ($y_R$) comprising a first and a second value, and a second control signal ($y_{DR}$) comprising a first and a second value;

2. transmitting the first output sequence of step (c)(1) when the first control signal comprises its associated second value and the second control signal comprises its associated first value, the second output sequence of step (c)(1) when the first control signal comprises its associated first value, and the third output sequence of step (c)(1) when both the first and the second control signals comprise their associated second values.

19. The method according to claim 18 characterized in that the method comprises the further steps of:

d. in performing step (c)(1), performing the steps of:

1. computing a received correlation coefficient ($\rho_R$) and a received power value ($\sigma_R^2$) related to the received coded sequence;

2. comparing the received correlation coefficient formed in step (d)(1) to a predetermined correlation threshold (K) and the received power value formed in step (d)(1) to a predetermined power value threshold (T), producing the first output control signal ($y_R$) of step (d)(1) which comprises its associated first value if both said received correlation coefficient and said received power value formed in step (d)(1) are greater than or equal to their associated predetermined threshold values and comprises its associated second value if either one of both said received correlation coefficient and said received power value formed in step (d)(1) is less than its associated predetermined threshold value;

3. producing the second output sequence of step (c)(1) in rsponse to the first control signal of step (d)(2) comprising its first value; and 4. in performing step (d)(2), if the first control signal comprises its associated second value, performing the steps of:

a. descrambling the received coded sequence to form an inverse sequence ($S_T^{-1}$);

b. computing a descrambled correlation coefficient ($\rho_{DR}$) and a descrambled power value ($\sigma_{DR}^2$) relative to the inverse sequence formed in step (d)(4) (a);

c. comparing the descrambled correlation coefficient formed in step (d) (4)(b) to the predetermined correlation threshold (K) and the descrambled power value formed in step (d)(4)(b) to the predetermined power threshold (T) and producing the second control signal ($y_{DR}$) of step (d)(1) which comprises its associated first value if both said descrambled correlation coefficient and said descrambled power value formed in step (d)(4)(b) are greater than or equal to their associated predetermined thresholds and comprises its associated second value if either one of both said descrambled correlation coefficient and said descrambled power value is less than its associated predetermined threshold; and d. producing the first output sequence of step (c)(1) if the second control signal formed in step (d)(4)(d) comprises its associated first value and the third output sequence of step (c)(1) if the second control signal formed in step (d)(4)(d) comprises its associated second value.

* * * * *